US006108513A

United States Patent [19]

Landa et al.

[11] Patent Number: 6,108,513

[45] Date of Patent: Aug. 22, 2000

[54] DOUBLE SIDED IMAGING

[75] Inventors: Benzion Landa; Ishaiau Lior, both of New Ziona; Yossi Rosen, Rehovot; Boaz Tagansky, Rishon Lezion, all of Israel

[73] Assignee: Indigo N.V., Maastricht, Netherlands

[21] Appl. No.: 09/289,378

[22] Filed: Apr. 12, 1999

Related U.S. Application Data

[62] Continuation of application No. 09/188,208, Nov. 9, 1998, which is a continuation of application No. 08/930,249, filed as application No. PCT/NL95/00199, Jun. 6, 1995, abandoned.

[30] Foreign Application Priority Data

Apr. 3, 1995 [IL] Israel ..... 113235

[51] Int. Cl.[7] ..... G03G 15/00

[52] U.S. Cl. ..... 399/384; 399/309; 399/401

[58] Field of Search ..... 399/384, 385, 399/401, 302, 308, 309, 364; 101/179, 220, 229; 271/184, 225

[56] References Cited

U.S. PATENT DOCUMENTS

| | | | |
|---|---|---|---|
| 4,504,138 | 3/1985 | Kuehnle et al. | 399/240 |
| 4,684,238 | 8/1987 | Till et al. | 399/308 |
| 4,794,651 | 12/1988 | Landa et al. | 430/110 |
| 4,974,027 | 11/1990 | Landa et al. | 399/249 |
| 5,047,808 | 9/1991 | Landa et al. | 399/308 |
| 5,089,856 | 2/1992 | Landa et al. | 399/308 |
| 5,105,227 | 4/1992 | Kitamura et al. | 399/317 |
| 5,280,326 | 1/1994 | Pinhas et al. | 399/296 |
| 5,346,796 | 9/1994 | Almong | 430/115 |
| 5,408,302 | 4/1995 | Manzer et al. | 399/306 |
| 5,410,384 | 4/1995 | Wachtler | 355/23 |
| 5,436,706 | 7/1995 | Landa et al. | 399/238 |
| 5,508,790 | 4/1996 | Belinkov et al. | 399/161 |
| 5,520,112 | 5/1996 | Schleinz et al. | 101/220 X |
| 5,546,178 | 8/1996 | Manzer et al. | 399/384 |
| 5,568,245 | 10/1996 | Ferber et al. | 399/384 |
| 5,659,875 | 8/1997 | Manzer et al. | 399/384 |
| 5,713,071 | 1/1998 | Hausmann | 399/401 |
| 5,745,829 | 4/1998 | Gazit et al. | 399/302 |
| 5,848,345 | 12/1998 | Stemmle | 399/401 |
| 5,860,053 | 1/1999 | Stemmle | 399/384 |
| 5,878,320 | 3/1999 | Stemmle | 399/384 |

FOREIGN PATENT DOCUMENTS

| | | |
|---|---|---|
| 9004216 | 4/1990 | WIPO . |
| 9301531 | 1/1993 | WIPO . |
| 9321566 | 10/1993 | WIPO . |
| 9402887 | 3/1994 | WIPO . |
| 9416364 | 7/1994 | WIPO . |
| 9427193 | 11/1994 | WIPO . |
| 9613761 | 5/1996 | WIPO . |

OTHER PUBLICATIONS

IBM Disclosure Bulletin, vol. 22, No. 6, Nov. 1979, New York, pp. 2465–2566, K. Sanders, "Two–Path Electrophotographic Print Process".

Xerox Disclosure Journal, vol. 9, No. 3, May 1984, Stamford, CT, pp. 201–203. Edward C. McIrvine "Method for Duplex Printing on Continuous Web Paper".

*Primary Examiner*—Sophia S. Chen

*Attorney, Agent, or Firm*—Greenblum & Berstein, P.L.C.

[57] ABSTRACT

A system for double-sided imaging on a continuous-web substrate having first and second substrate surfaces, the system including an imaging device including a toner-image bearing surface having selectively formed thereon first and second images. The system further includes a web-feeder system which selectively brings the first and second substrate surfaces into operative engagement with the toner-image bearing surface, to transfer thereto the first and second images, respectively, in accordance with a preselected imaging sequence.

63 Claims, 8 Drawing Sheets

LOOP 1 HIGH
106
LOOP 1 LOW
108
LOOP 2 HIGH
118
LOOP 2 LOW
120
LOOP 3 HIGH
136
LOOP 3 LOW
138
150
CONTROLLER
152
INPUT . . .
154
TENSION 1
156
IMPRESSION 1
158
INDEXER 1
160
TENSION 2
162
IMPRESSION 2
164
INDEXER 2
166
OUTPUT
DET 3
DET 2
DET 1
144
128
114

DOUBLE SIDED IMAGING

CROSS REFERENCE TO RELATED APPLICATIONS

This application is a continuation of application Ser. No. 09/188,208, filed Nov. 9, 1998, which is a continuation of application Ser. No. 08/930,249, filed Jun. 6, 1995, now abandoned which is the U.S. National Stage of International Application No. PCT/NL95/00199, filed Jun. 6, 1995. The entire disclosure of application Ser. Nos. 09/188,208 and 08/930,249 is considered as being part of the disclosure of this application, and the entire disclosure of application Ser. Nos. 09/188,208 and 08/930,249 is expressly incorporated by reference herein in its entirety.

FIELD OF THE INVENTION

The present invention relates generally to improvements in imaging apparatus and, more particularly, to imaging on both sides of a substrate.

BACKGROUND OF THE INVENTION

There are various applications for imaging on both sides of a substrate such as paper Today, double sided imaging is generally carried out by a system including first and second imaging devices, wherein one side of the substrate is imaged by the first imaging device and the opposite side of the substrate is imaged by the second imaging device. It is appreciated, however, that the use of two imaging devices configured for double-sided printing is expensive and highly space consuming.

If the substrate is provided in sheets having predetermined dimensions adapted for a given page layout, it is possible to image both sides of each sheet by, first, feeding the sheet with a first surface interfacing the imaging device and, then, refeeding the sheet with the second, opposite, surface facing the imaging device. This method is not available for web-fed imaging.

SUMMARY OF THE INVENTION

It is an object of the present invention to provide an electrostatic imaging system in which a single imaging device is used for imaging both surfaces of a web type, i.e. a continuous, substrate.

According to a preferred embodiment of the present invention, a first surface of a continuous substrate is fed to the imaging device by a controlled feeding mechanism and at least one image is formed on the first surface of the substrate. Then, by guiding the continuous substrate through an inverter mechanism, a second, opposite, surface of the substrate is controllably fed to the imaging device and at least one image is formed on the second surface of the substrate. The controlled feedings of the first and second surfaces of the substrate are preferably synchronized so as to control the relative locations of the images formed on the first and second surfaces.

In a preferred embodiment of the invention, a first plurality of images are formed on the first surface of the substrate and a second plurality of corresponding images are formed on the second surface of the substrate, wherein the order of imaging is adapted to appropriately locate each of the second plurality of images opposite a corresponding image of the first plurality of images. Preferably, the order of imaging includes, initially, imaging a predetermined number of images on the first surface to account for the length of continuous substrate separating between imaging of the first surface and imaging of the second surface and, then, alternatingly imaging on the first and second surfaces such that each imaging on the first surface is followed by imaging on the second surface.

In a preferred embodiment of the invention, the imaging device includes an intermediate transfer member (ITM) which transfers developed toner images from an imaging surface, for example a photoconductor surface, to the substrate. The device preferably further includes first and second impression members, wherein the first impression member urges the first surface of the substrate against the ITM at a first image transfer region and the second impression member urges the second surface of the substrate against the ITM at a second image transfer region. According to this preferred embodiment of the invention, a given portion of the continuous substrate is fed, first, to the first image transfer region and then, after being guided through the inverter mechanism, the substrate is fed to the second image transfer region.

In a preferred embodiment of the invention, particularly suitable for high speed imaging, an improved BID (Binary Image Development) system is used in which selected portions of a viscous layer of concentrated liquid toner are transferred onto the photoconductor surface to develop latent images formed thereon. Alternatively, a BID development system is used in which only a portion of the thickness of the concentrated layer of toner is transferred onto the photoconductor surface. The developed images are subsequently transferred to the substrate, preferably via the ITM, with substantially no toner residue remaining on the ITM.

There is thus provided in accordance with a preferred embodiment of the invention, a system for double-sided, electrostatic imaging on a continuous-web substrate having first and second substrate surfaces, the system including:

an imaging device comprising an image transfer member with a toner-image bearing surface having selectively formed thereon first and second images; and a web-feeder system which selectively brings the first and second substrate surfaces into operative engagement with the toner-image bearing surface, to transfer thereto the first and second images, respectively, in accordance with a preselected imaging sequence.

In a preferred embodiment of the invention, the first substrate surface engages the toner-image bearing surface at a first impression region and the second substrate surface engages the toner-image bearing surface at a second impression region. Preferably, the predetermined imaging sequence includes first surface imaging cycles, during which cycles the first images are transferred to the first substrate surface, and second surface imaging cycles, during which cycles the second images are transferred to the second substrate surface. In one embodiment of the invention, the predetermined imaging sequence includes a plurality of consecutive first surface imaging cycles followed by alternating, first surface and second surface, imaging cycles.

In a preferred embodiment of the present invention, the web-feeder system includes a first impression member which urges the continuous substrate against the toner-image bearing surface during each first surface imaging cycle, and a second impression member which urges the continuous substrate against the toner-image bearing surface during each second surface imaging cycle. Preferably, the web-feeder system further includes a substrate inverter, operating on the continuous substrate between the first and second impression members, which inverts between the first and second surfaces of the continuous substrate.

Additionally, in a preferred embodiment, the web-feeder system includes a substrate advance mechanism operative for advancing the continuous substrate through the first and second impression regions.

In a accordance with a preferred embodiment of the invention, the web-feeder system further includes a controller which controls the advance of the continuous substrate through the first and second impression regions, in accordance with the predetermined imaging sequence, by controlling the operation of the substrate advance mechanism. The controller preferably also controls the engagement and disengagement of the first and second substrate surfaces with the toner-image bearing surface, in accordance with the predetermined imaging sequence, by controlling the position of the first and second impression members relative to the toner-image bearing surface.

In a preferred embodiment of the invention, the first images are formed on the first substrate surface with a preselected spacing. Preferably, the imaging device produces a post-image mark on the space following each first image on the first substrate surface.

In a preferred embodiment of the invention, the advancing mechanism rewinds a preselected length of the continuous substrate through the first impression region following each first surface imaging cycle. Preferably, according to this embodiment, the continuous substrate is accelerated to a surface velocity comparable with that of the toner-image bearing surface before each first surface imaging cycle.

Further, in a preferred embodiment of the invention, the web-feeder system further includes a first mark detector associated with the first substrate surface, ahead of the first impression region, which detects the post image marks on the first substrate surface and produces first detection signals in response thereto. Preferably, in this embodiment of the invention, the controller triggers each first surface imaging cycle in response to the first detection signal of the preceding post-image mark.

In a preferred embodiment of the invention, the advancing mechanism rewinds a preselected length of the continuous substrate through the second impression region following each second surface imaging cycle. Preferably, according to this embodiment, the continuous substrate is accelerated to a surface velocity comparable with that of the toner-image bearing surface before each second surface imaging cycle.

Further, in a preferred embodiment of the invention, the web-feeder system further includes a second mark detector associated with the first substrate surface, between the first and second impression regions, which detects the post image marks on the first substrate surface and produces second detection signals in response thereto. Preferably, in this embodiment of the invention, the controller triggers each second surface imaging cycle in response to the second detection signal of the preceding post-image mark.

In accordance with a preferred embodiment of the invention, the web-feeder system further includes a cutter, associated with the continuous substrate downstream of the second impression region, which cuts the continuous substrate at the spaces between the first images on the first substrate surface. Preferably, the web-feeder system also includes a third mark detector associated with the first substrate surface, ahead of the cutter, which detects the post image marks on the first substrate surface and produces third detection signals in response thereto. The controller preferably activates the cutter in response to the third detection signals.

According to a preferred embodiment of the invention, the web-feeder system further includes at least one free-loop arrangement which contains a variable length of the continuous substrate. The at least one free-loop arrangement preferably includes a first free-loop arrangement ahead of the first impression region. The at least one free-loop arrangement preferably further includes a second free-loop arrangement between the first impression region and the second impression region. The web-feeder system preferably also includes a third free-loop arrangement, between the second impression region and the cutter, which contains a variable length of the continuous substrate.

In a preferred embodiment of the invention, the web-feeder system further includes a first length detector, associated with the continuous substrate between the first and second impression regions, which produces an electric output responsive to the position of the continuous substrate relative to the first impression region. The first length detector preferably includes an encoder. In a preferred embodiment, the controller addresses the first mark detector only within preset, first, detection time windows and wherein the time gaps between the first detection windows are set in accordance with the output of the first length detector.

In a preferred embodiment, the web-feeder system further includes a second length detector, associated with the continuous substrate downstream of the second impression region, which produces an electric output responsive to the position of the continuous substrate relative to second impression region. The second length detector includes an encoder. In a preferred embodiment, the controller addresses the second mark detector only within preset, second, detection time windows and wherein the time gaps between the second detection windows are set in accordance with the outputs of the first and second length detectors.

In a preferred embodiment of the invention, the controller addresses the third mark detector only within preset, third, detection time windows and wherein the time gaps between the third detection windows are set in accordance with the output of the second length detector.

Further, in accordance with a preferred embodiment of the present invention there is provided a method for double-sided imaging on a continuous-web substrate, having first and second substrate surfaces, using an electrostatic imaging device including an image transfer member having an toner-image bearing surface, the method including:

providing a first toner image on the toner-image bearing surface;

transferring the first toner image from the toner-image bearing surface to the first substrate surface;

providing a second toner image on the toner-image bearing surface; and transferring the second toner image from the toner-image bearing surface to the second substrate surface Alternatively, in a preferred embodiment of the invention, there is provided a method for double-sided imaging on a continuous-web substrate, having first and second substrate surfaces, using an electrostatic imaging device including an image transfer member having an toner-image bearing surface, the method including:

selectively forming on the toner-image bearing surface first and second toner images, in accordance with a preselected imaging sequence; and selectively transferring the first and second toner images to the first and second substrate surfaces, respectively, in accordance with the preselected imaging sequence. In a preferred variation of this embodiment of the invention, selectively forming the first and second toner images in accordance with the predetermined imaging sequence includes, first, consecutively forming a plurality of first toner images and, then, alternatingly forming first and second toner images.

In a preferred embodiment of the invention, transferring the first toner image includes transferring the first toner image at a first impression region and wherein transferring the second toner image includes transferring the second toner image at a second impression region. Additionally, in a preferred embodiment of the invention, the method including inverting the first and second substrate surfaces of the continuous substrate between the first and second impression regions.

In a preferred embodiment of the invention, the imaging method further includes advancing the continuous substrate through the first and second impression regions in accordance with the predetermined imaging sequence.

According to a preferred embodiment of the invention, transferring the first toner images to the first substrate surface includes transferring the first toner images with a preselected spacing. Preferably, in this preferred embodiment, the method further includes producing a post-image mark on the space following each first toner image.

In a preferred embodiment, the method further includes rewinding a preselected length of the continuous substrate through the first impression region following transferring of each first toner image. Preferably, the method also includes accelerating the continuous substrate to a surface velocity comparable with that of the toner-image bearing surface before transferring of each first toner image.

Additionally, in a preferred embodiment, the method includes detecting the post image marks on the first substrate surface ahead of the first impression region. Preferably, in this preferred embodiment, the method also includes triggering the transferring of each first toner image in response to the-post-image mark of the preceding first toner image.

In a preferred embodiment, the method further includes rewinding a preselected length of the continuous substrate through the second impression region following transferring of each second toner image. Preferably, the method also includes accelerating the continuous substrate to a surface velocity comparable with that of the toner-image bearing surface before transferring of each second toner image.

Additionally, in a preferred embodiment, the method includes detecting the post image marks on the first substrate surface between the first and second impression regions. Preferably, in this preferred embodiment, the method also includes triggering the transferring of each second toner image in response to the post-image mark of the preceding first toner image.

In a preferred embodiment of the invention, the imaging method further includes cutting the continuous substrate at the spaces between the first images on the first substrate surface. Preferably, in this preferred embodiment, the method further includes detecting the post image marks on the first substrate surface downstream of the second impression region. Preferably, cutting the continuous substrate includes cutting the continuous substrate in response to detection of post-image marks.

In a preferred embodiment of the invention, the imaging method further includes monitoring the position of the continuous substrate relative to the first impression region. Preferably, in this embodiment of the invention, detecting the post-image marks on the continuous substrate ahead of the first impression region includes detecting the post-image marks only within preset, first, detection time windows. In a preferred embodiment, the imaging method includes setting the time gaps between the first detection time windows in accordance with the monitored position of the continuous substrate relative to the first impression region.

In a preferred embodiment of the invention, the imaging method further includes monitoring the position of the continuous substrate relative to the second impression region. Preferably, in this embodiment of-the invention, detecting the post-image marks on the continuous substrate between the first and second impression regions includes detecting the post-image marks only within preset, second, detection time windows. In a preferred embodiment, the imaging method includes setting the time gaps between the second detection time windows in accordance with the monitored position of the continuous substrate relative to the second impression region.

According to one, preferred, embodiment of the present invention, the toner-image bearing surface includes a developed imaging surface. Preferably, the imaging surface includes a photoreceptor surface.

According to another, preferred, embodiment of the present invention, the imaging device includes an intermediate transfer member and the toner-image bearing surface includes a surface of the intermediate transfer member.

There is further provided, in a preferred embodiment of the invention, a squeegee device for squeegeeing a first surface comprising:

a squeegee roller having a squeegee surface, a first portion of which engages said first surface;

a leaf spring which is applied to a second portion of said squeegee surface to urge the squeegee roller against the first surface, wherein the leaf spring contacts the squeegee roller along its length at discrete regions separated by non-contacting areas.

Preferably, portions of the spring comprises a low friction material contacting the squeegee roller at said second portion.

There is further provided, in accordance with a preferred embodiment of the invention, a squeegee device for squeegeeing a first surface comprising:

a squeegee roller having a squeegee surface, a first portion of which engages said first surface;

a leaf spring which is applied to said first surface and is applied to a-second portion of said squeegee surface to urge the squeegee roller against the first surface, and a wire wrapped around the leaf spring such that the wire contacts the squeegee surface at a plurality of points along the length of the roller, said points being separated by spaces at which no contact is made with the squeegee roller.

Preferably, the wire comprises a low friction material, preferably, teflon.

In a preferred embodiment of the invention, the leaf spring contacts the squeegee roller along substantially its entire length.

There is further provided, in accordance with a preferred embodiment of the invention, a cleaning device for removing residual toner from a toner-bearing surface comprising:

a first, rotating, roller having a conductive surface contacting the toner-bearing surface with substantially zero relative motion therebetween;

a sponge roller rotating in the same sense as that of the first roller, wherein the sponge roller is substantially compressed by said first roller at a region of engagement therebetween; and a second roller which compresses said sponge roller at a region thereof remote from said region of engagement.

In a preferred embodiment of the invention, the first roller is biased to a voltage which attracts residual toner particles on said toner-bearing surface to said conductive surface.

Preferably, the device includes a resilient blade engaging said conductive surface where said surface leaves said region of engagement and operative to remove toner from said conductive surface.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1:
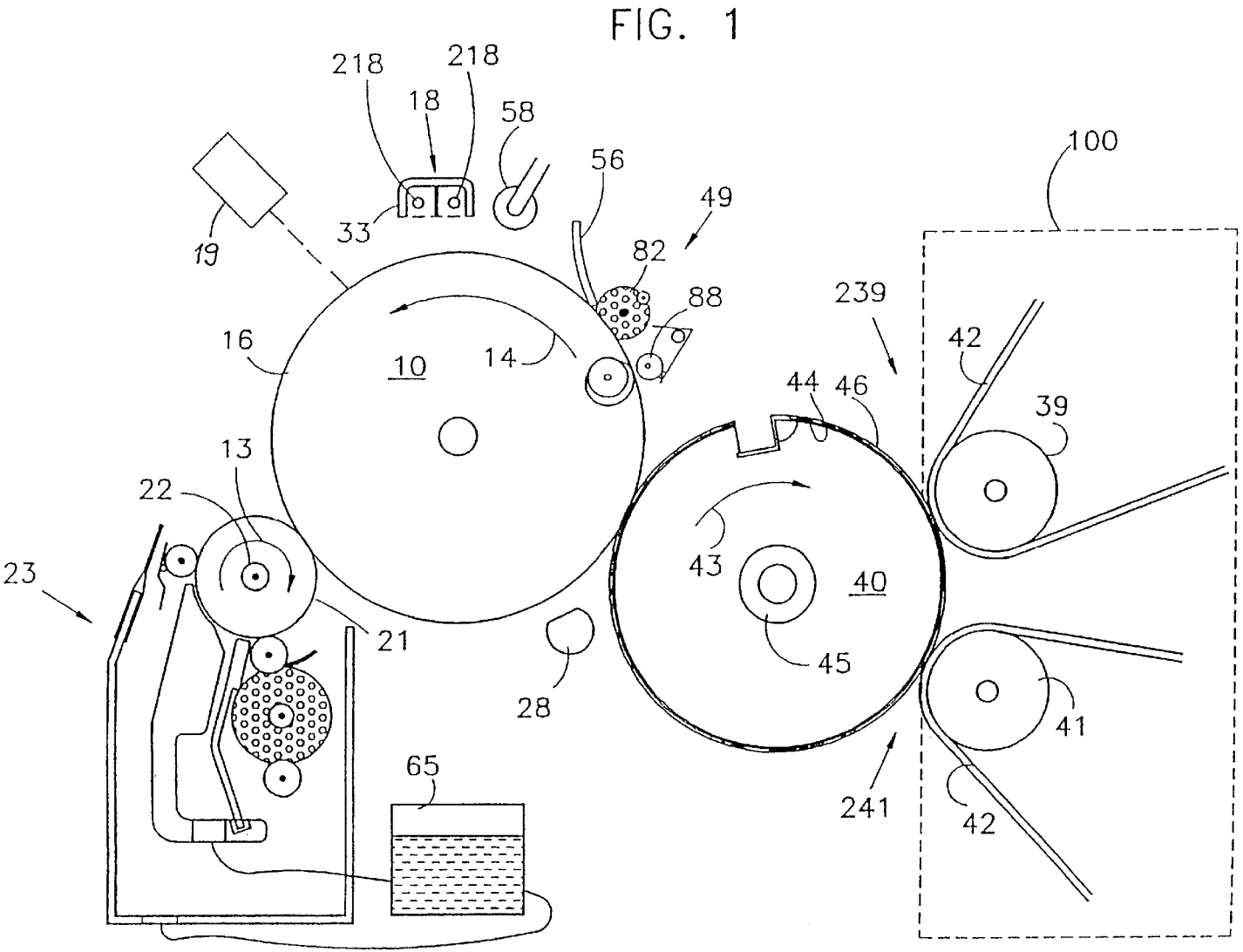
FIG. 1 is a schematic illustration of a system for double-sided imaging constructed and operative in accordance with a preferred embodiment of the present invention.

Reference is now made to FIG. 1 which illustrates imaging apparatus constructed and operative in accordance with a preferred embodiment of the present invention.

The apparatus of FIG. 1 comprises a drum 10 arranged for rotation in a direction generally indicated by arrow 14. Drum 10 preferably has a cylindrical photoconductive surface 16, made of selenium, a selenium compound, an organic photoconductor or any other suitable photoconductor known in the art. Photoconductive surface may be in the form of a photoreceptor sheet and may use any suitable arrangement of layers of materials as is known in the art. However, in the preferred embodiment of the invention, certain of the layers of photoreceptor sheet 16 are removed from the ends of the sheet to facilitate its mounting on drum 10.

This preferred photoreceptor-sheet and preferred methods of mounting it on drum 10 are described in a co-pending application of Belinkov et al., PHOTORECEPTOR SHEET AND IMAGING SYSTEM UTILIZING SAME, filed Sep. 7, 1994, assigned Ser. No. 08/301,775, now U.S. Pat. No. 5,508,790 and corresponding applications in other countries, the disclosure of which is incorporated herein by reference. Alternatively, photoreceptor 16 may be deposited on drum 10 and may form a continuous surface.

When the apparatus is operated, drum 10 rotates and photoconductive surface 16 is charged by a charger 18 to a generally uniformly pre-determined voltage, typically a negative voltage on the order of 1000 volts. Charger 18 may be any type of charger known in the art, such as a corotron, a scorotron or a roller.

In a preferred embodiment of the invention, charger 18 is a double scorotron including a housing and two corona wire segments 218. Although desirably, particularly for high-speed imaging, the voltage between wires 218 and surface 16 should preferably be as high as possible, the actually obtained voltage is generally not higher than 7000–7500 Volts, typically 7300 Volts, due to discharging between wires 218 and housing 33. The present invention, however, provides a method for raising the voltage between wire segments 218 and surface 16. According to the present invention, housing 33 is electrically insulated from other elements of the imaging device and is charged to a relatively high voltage, preferably on the order of 1500 Volts. This enables charging of wires 218 to a voltage on the order of 9000 Volts, maintaining the voltage difference between wires 218 and housing 33 within a safe range.

Continued rotation of drum 10 brings charged photoconductive surface 16 into image receiving relationship with an exposure means such as a light source 19, which may be a laser scanner (in the case of a printer) or the projection of an original (in the case of a photocopier). In a preferred embodiment of the present invention, imaging apparatus 19 is a modulated laser beam scanning apparatus, or other laser imaging apparatus such as is known in the art.

Light source 19 forms a desired latent image on charged photoconductive surface 16 by selectively discharging a portion of the photoconductive surface, the image portions being at a first voltage and the background portions at a second voltage. The discharged portions preferably have a negative voltage of less than about 100 volts.

Continued rotation of drum 10 brings charged photoconductive surface 16, bearing the electrostatic latent image, into operative engagement with the surface 21 of a developer roller 22 which is part of developer assembly 23, more fully described below with reference to FIG. 4. Developer roller 22 rotates in a direction opposite that of drum 10, as shown by arrow 13, such that there is substantially zero relative motion between their respective surfaces at the point of contact. Surface 21 of developer roller 22 is preferably composed of a soft polyurethane material, preferably made more electrically conductive by the inclusion of conducting additives, while the core of developer roller 22 may be composed of any suitable electrically conductive material. Alternatively, drum 10 may be formed of a relatively resilient material, and in such case surface 21 of developer roller 22 may be composed of either a rigid or a compliant material. Developer roller 22 is preferably charged to a negative voltage of approximately 300–600 volts, desirably approximately −400 volts.

As described below, surface 21 is coated with a very thin layer of concentrated liquid toner, preferably containing 20–50% charged toner particles, more preferably 25% solids or more. The layer is preferably between 5 and 30 $\mu$m, more preferably between 5 and 15 $\mu$m, thick. Developer roller 22 itself is charged to a voltage that is intermediate the voltage of the charged and discharged areas on photoconductive surface 16.

In a preferred embodiment of the invention, a liquid toner similar to the toner described in Example 1 of U.S. Pat. No. 4,794,651, the disclosure of which is incorporated herein by reference, is used although other types of toner are usable in the invention. For colored toners the carbon black in the preferred toner is replaced by colored pigments as is well known in the art. The liquid toner is preferably maintained in a toner reservoir 65 which is associated with development assembly 23.

When surface 21 of developer roller 22 bearing the layer of liquid toner concentrate is engaged with photoconductive surface 16 of drum 10, the difference in voltages between developer roller 22 and photoconductive surface 16 causes the selective transfer of the layer of toner particles to photoconductive surface 16, thereby developing the desired latent image. Depending on the choice of toner charge polarity and the use of a "write-white" or "write-black" system, the layer of toner particles will be selectively attracted to either the charged or discharged areas of photoconductive surface 16, and the remaining portions of the toner layer will continue to adhere to surface 21 of developer roller 22.

Because the transfer of the concentrated layer of toner is much less mobility dependent than in normal electrophoretic development, the process described above occurs at a relatively high speed. Also, since the layer already has a high density and viscosity, there is no need to provide for metering devices, rigidizing rollers and the like which would otherwise be necessary to remove excess liquid from the developed image to attain the desired density of toner particles of the developed image.

Figure 2:
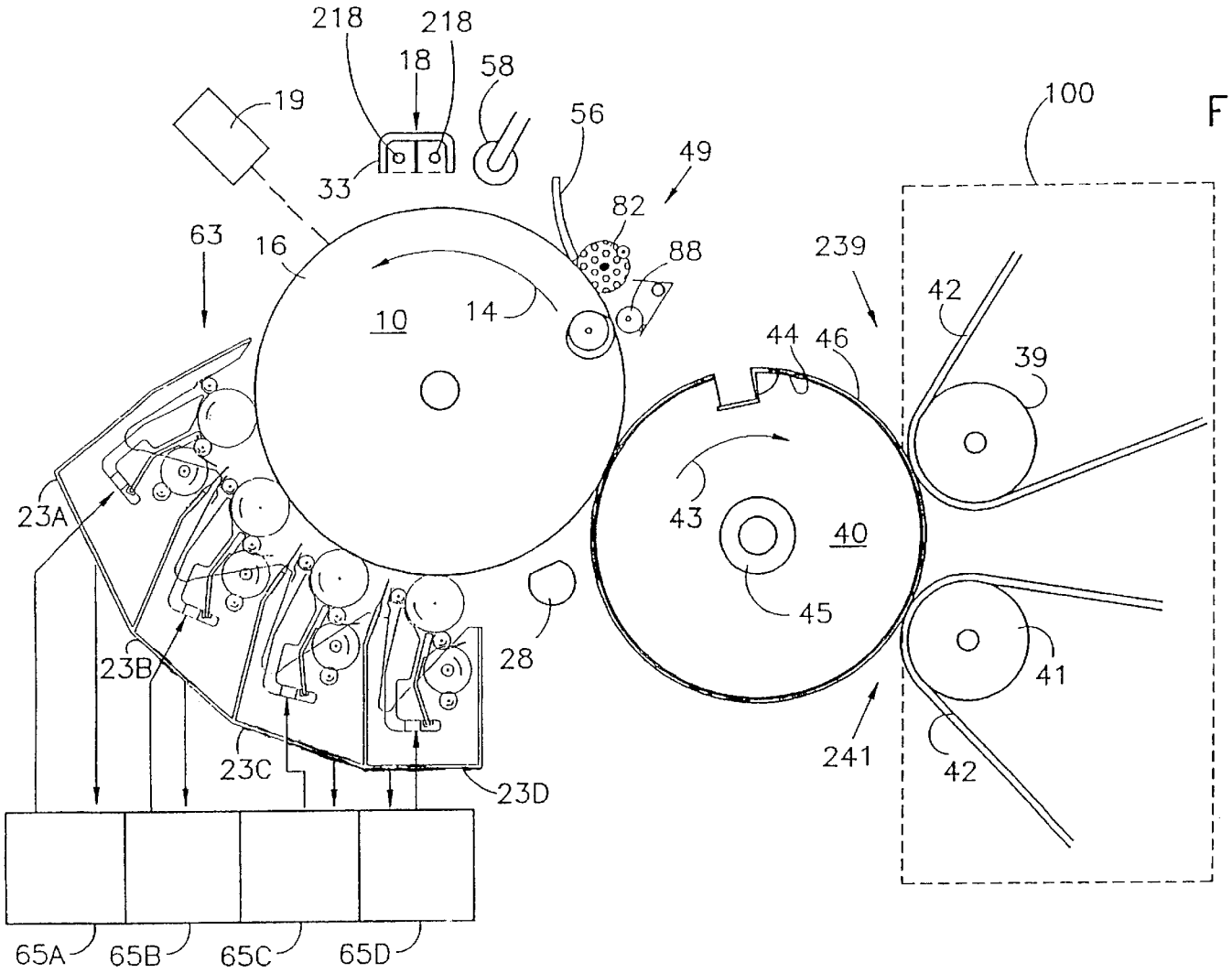
FIG. 2 is a schematic illustration of a system for multi-color, double-sided imaging, constructed in accordance with a preferred embodiment of the present invention.

For multicolor systems, as shown in FIG. 2, a plurality of development assemblies 23A–23D may be provided, one for each color of the multi-color image. According to this embodiment of the invention, assemblies 23A–23D sequentially engage photoconductive surface 16 to develop sequentially produced latent images thereon. Assemblies 23A–23D may be combined into an integrated, multi-color, development assembly 63.

The present invention is described in the context of a BID (Binary Image Development) system in which the concentrated layer of liquid toner is completely transferred to photoconductor surface 16 during development. However, it should be appreciated that the present invention is also compatible with a partial BID system in which only a portion of the thickness of the concentrated toner layer is transferred to surface 16 by appropriately adjusting the development voltages. A preferred partial BID system of this type is described in PCT publication WO 94/16364, the disclosure of which is incorporated herein by reference.

Downstream of development assembly 23, as shown in FIGS. 1 and 2, a preferred embodiment of the imaging apparatus further includes a background discharge device 28. Discharge device 28 is operative to flood the surface 16 with light which discharges the voltage remaining on surface 16, mainly to reduce electrical breakdown and improve subsequent transfer of the image. Operation of such a device in a write black system is described in U.S. Pat. No. 5,280,326, the disclosure of which is incorporated herein by reference.

The latent image developed by means of the process described above may then be directly transferred to a desired substrate in a manner well known in the art. Alternatively, as in the preferred embodiments of the invention shown in FIGS. 1 and 2, the developed image is transferred to the desired substrate via an intermediate transfer member 40, which may be a drum or belt, in operative engagement with photoconductive surface 16 of drum 10 bearing the developed image. Intermediate transfer member 40 rotates in a sense opposite to that of photoconductive surface 16, as shown by arrow 43, providing substantially zero relative motion between their respective surfaces at the point of image transfer.

Intermediate transfer member 40 is operative for receiving the toner image from photoconductive surface 16 and for transferring the toner image to a final substrate 42, such as paper. Final substrate 42, which is preferably continuously fed as described below, is urged against the image bearing surface of ITM 40 by either a first impression roller 39 or a second impression roller 41, in accordance with a predetermined imaging sequence, as described in detail below. The transfer of the toner image from ITM 40 to substrate 42 is preferably electrostatically assisted by charging impression rollers 39 and 41 to an appropriate voltage, which is adapted to counteract the electrostatic attraction of the toner image to ITM 40. In a preferred embodiment of the invention, substrate 42 engages ITM 40 at a first impression region 239, when urged by roller 39, and at a second impression region 241, when urged by roller 41. Impression rollers 39 and 41 form part of a web-feeder system 100 which is described below with reference to FIG. 5.

Disposed internally of intermediate transfer member 40 there may be provided a heater 45, to heat intermediate transfer member 40 as is known in the art. Transfer of the image to intermediate transfer member 40 is preferably aided by providing electrification of intermediate transfer member 40 to provide an electric field between intermediate transfer member 40 and the image areas of photoconductive surface 16. Intermediate transfer member 40 preferably has a conducting layer 44 underlying an elastomer layer 46, which is preferably a slightly conductive resilient polymeric layer.

Intermediate transfer member (ITM) 40 may be any suitable intermediate transfer member, for example, as described in U.S. Pat. Nos. 4,684,238 and 4,974,027 or in PCT Publication WO 90/04216, the disclosures of which are incorporated herein by reference. Alternatively, in a preferred embodiment of the invention, ITM 40 has a multi-layered transfer portion such as those described below or in U.S. Pat. Nos. 5,089,856 and 5,047,808, or in U.S. patent application Ser. No. 08/371,117, filed Jan. 11, 1995, now U.S. Pat. No. 5,745,829 and entitled IMAGING APPARATUS AND INTERMEDIATE TRANSFER BLANKET THEREFOR and corresponding applications in other countries, the disclosures of all of which are incorporated herein by reference. Member 40 is maintained at a suitable voltage and temperature for electrostatic transfer of the image thereto from image bearing surface 16.

In accordance with a preferred embodiment of the invention, after developing each image in a given color, the single color image is transferred to intermediate transfer member 40. Subsequent images in different colors are sequentially transferred in alignment with the previous image onto intermediate transfer member 40. When all of the desired images have been transferred thereto, the complete multi-color image is transferred from transfer member 40 to substrate 42. Impression rollers, 39 or 41, produce operative engagement between intermediate transfer member 40 and substrate 42 at regions 239 or 241, respectively, when transfer of the composite image to substrate 42 takes place.

While the embodiment of the invention in which all the colors are transferred is most preferred, each single color image can be separately transferred to the substrate via the intermediate transfer member. In this case, the substrate may be fed through the imaging device once for each color, using dual-feeder system 100. Alternatively, the intermediate transfer member can be omitted and the developed single color images transferred sequentially directly from surface 16 of drum 10 to substrate 42.

It should be understood that the invention is not limited to the specific type of image forming system used and the present invention is also useful with any suitable imaging system which forms a liquid toner image on an image forming surface, such as that shown in the above referenced patent application Ser. No. 08/371,117, now U.S. Pat. No. 5,745,829 and, for some aspects of the invention, with powder toner systems. Furthermore some aspects of the invention are suitable for use with offset printing systems as are well known in the art. The specific details given above for the image forming system are included as part of a best mode of carrying out the invention, however, many aspects of the invention are applicable to a wide range of systems as known in the art for electrostatic and offset ink printing and copying.

Following the transfer of the toner image to substrate 42 or to intermediate transfer member 40, photoconductive surface 16 engages a cleaning station 49 which may be any cleaning station known in the art. However, in a preferred embodiment of the invention, cleaning station 49 is an improved cleaning station which also functions as a cooling station, as described below with reference to FIG. 3.

Figure 3:
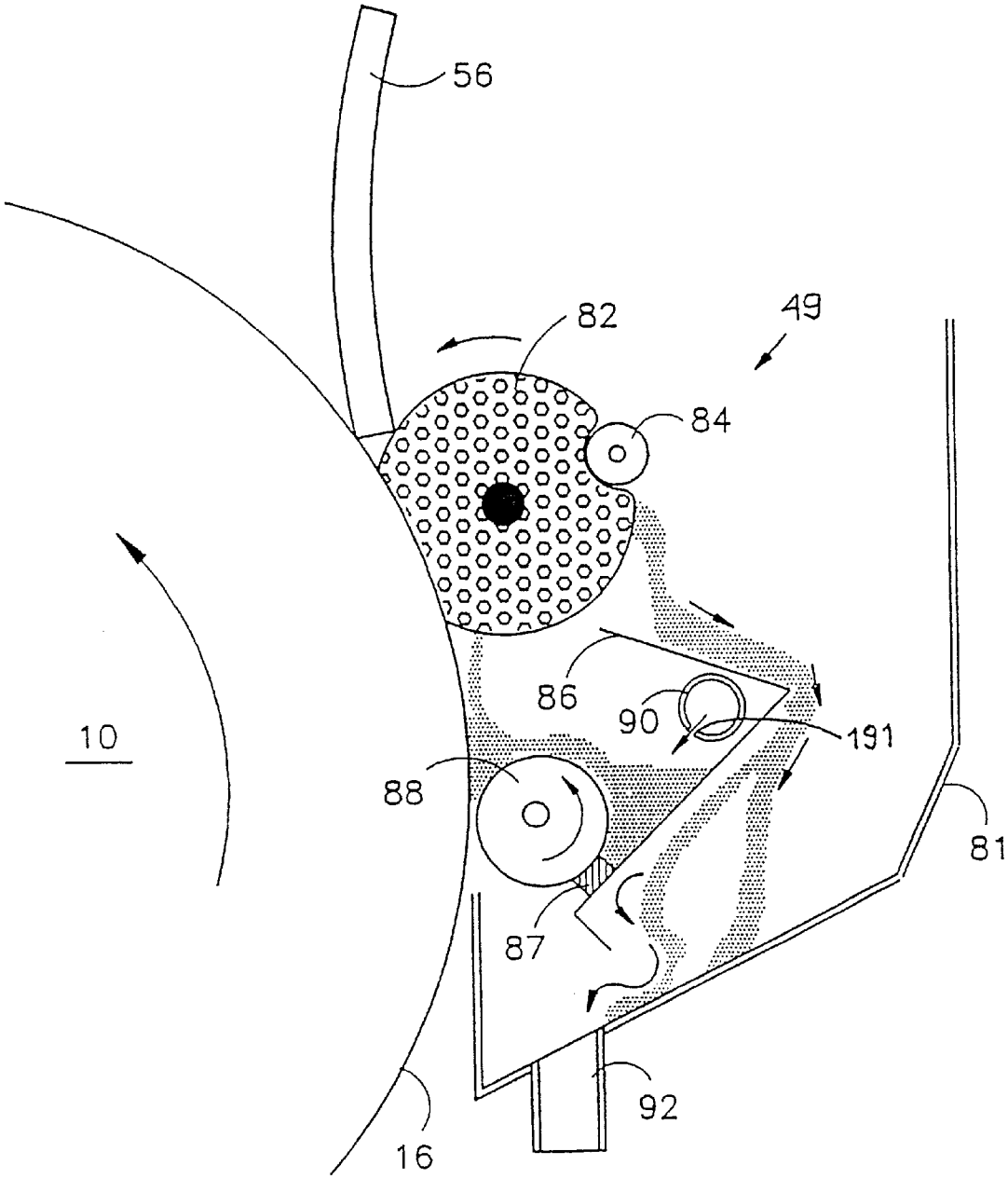
FIG. 3 is a detailed schematic illustration of a cleaning station constructed and operative in accordance with a preferred embodiment of the present invention.

According to the preferred embodiment of FIG. 3, cleaning station 49 includes a casing 81 which is associated with a carrier liquid inlet 90 and a carrier liquid outlet 92. Carrier liquid inlet 90 preferably includes a perforated nozzle 191 which disperses the supplied carrier liquid. Fresh and, preferably, cooled carrier liquid is preferably pumped from a carrier liquid reservoir (not shown) to inlet 90 which scatters the liquid in the direction of a wet cleaning roller 88. Wet cleaning roller 88 is preferably formed of a relatively rigid material, such as metal, and is mounted juxtaposed with surface 16 of drum 10, preferably with a gap of 120 to 150 micrometers from surface 16. Roller 88, which preferably has a diameter of approximately 22 millimeters, is preferably rotated in the same sense as that of drum 10, such that their respective surfaces move in opposite directions at the region of interface. In a preferred embodiment of the invention, the linear velocity of surface 16 is between 60 and 150 centimeters per second, and the surface velocity of roller 88 is equal to approximately 80 percent of the velocity of surface 16. This relative motion in combination with the constant supply of fresh carrier liquid from the reservoir results in thorough wetting of surface 16. The constant supply of fresh carrier liquid from inlet 90 is also operative to cool surface 16 of drum 10, so as to counteract heating of surface 16 by other elements of the imaging apparatus, such as the ITM.

The toner on surface 16, which is now diluted in the wetting carrier liquid, is carried by surface 16 of drum 10 towards a sponge roller 82 which is urged against surface 16, such that the surface of roller 82 is deformed inwardly by approximately 1.5 millimeters. Sponge roller 82, which is preferably constructed of an approximately 4 millimeter layer of open-cell polyurethane around a metal core having a diameter of approximately 14 millimeters, absorbs the diluted toner and scrubs it off surface 16. As shown in FIG. 3, sponge roller 82 preferably rotates in the same sense as that of drum 10, such that their respective surfaces move in opposite directions at their region of contact.

A squeezer roller 84 which is urged deeply into sponge roller 82, preferably to a depth of approximately 2 millimeters from the original surface of roller 82, squeezes used carrier liquid out of roller 82. Squeezer 84, which is preferably a metal roller having a diameter of approximately 16 millimeters, is preferably an idler roller, i.e. rotates in response to the rotation of sponge roller 82. A scraper 56, preferably a resilient blade urged against surface 16 next to sponge roller 82, completes the removal of any residual toner on surface 16 which may have not been removed by sponge roller 82. Blade 56 is preferably formed of polyurethane and has a thickness of approximately 3 millimeters.

The used carrier liquid squeezed out of roller 82 is drained by free-fall, along the surface of a fluid guide 86 which separates the relatively warm and soiled carrier liquid from the fresh carrier liquid supplied by inlet 90, back to the liquid toner reservoir via carrier liquid outlet 92. Fluid guide 86 is preferably resiliently urged against the surface of roller 88 via a, preferably spongy, sealing pad 87. Fluid guide 86 is preferably formed of metal and sealing pad 87 is preferably formed of closed-cell polyurethane.

A lamp 58 completes the imaging cycle by removing any residual charge, characteristic of the previous image, from photoconductive surface 16, if necessary. In some embodiments of the present invention, lamp 58 may be omitted and surface 16 is discharged only by discharge device 28, as described above with reference to FIG. 1 and FIG. 2.

It is to be understood that, in a preferred embodiment of the invention, the liquid toner concentrate which is transferred to drum 10 has substantially the same toner particle concentration as the image when it is transferred from drum 10. This is in contrast to traditional liquid development where the liquid developer has a comparatively low concentration of particles before development and where excess liquid is removed from the image before transfer from the photoconductor. It is also in contrast to U.S. Pat. No. 4,504,138, in which the toner supplied to the drum is more concentrated, but where excess liquid must still be removed from the image before transfer to the final substrate. In a preferred embodiment of the present invention, the toning material developed onto drum 10 is at a solids concentration substantially equal to that of the image transferred from the drum. Since the toner supplied during development to surface 21 of developer roller 22 is generally not sufficiently concentrated, the toner on surface 21 is further concentrated before contact with drum 10, for example by mechanical and electrical squeegeeing as described below with reference to FIG. 4.

In addition to the details of the imaging methods and apparatus given above, additional details of imaging processes and devices are given in the patents and publications incorporated herein by reference.

Figure 4:
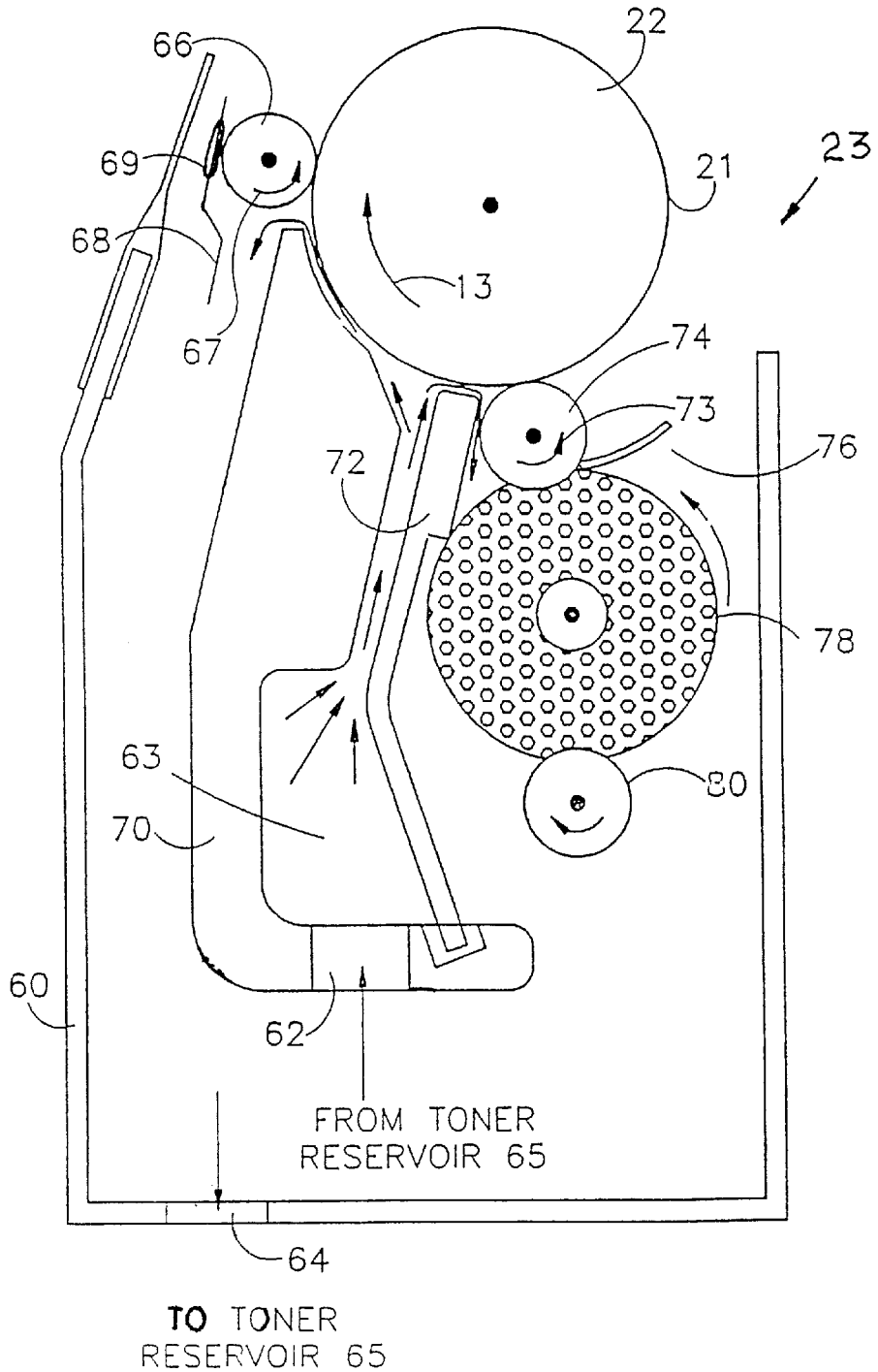
FIG. 4 is a detailed schematic illustration of a developer assembly constructed and operative in accordance with a preferred embodiment of the present invention.

Reference is now made to FIG. 4 which schematically illustrates the construction and operation of developer assembly 23. Developer assembly 23, including developer roller 22 and other elements described below, may be a fixed component within the imaging apparatus or, alternatively, assembly 23 may take the form of a replaceable cartridge (not shown) which is readily inserted into the housing of the imaging apparatus and removed therefrom when the supply of liquid toner concentrate has been depleted.

As shown in FIG. 4, assembly 23 preferably includes a housing 60 having a toner inlet 62 and a toner outlet 64 which are associated with toner reservoir 65. In accordance with a preferred embodiment of the invention, the liquid toner in reservoir 65 contains up to 8 percent charged toner particles, preferably 1.8–2 percent, and carrier liquid. Fresh liquid toner from container 65 is preferably pumped via toner inlet 62 into an inlet chamber 63 of assembly 23 by a pump (not shown), and unused toner is returned from housing 60 to reservoir 65 via toner outlet 64. In multi-color systems, as shown in FIG. 2, assemblies 23A–23D of multi-color development assembly 63 are associated with respective reservoirs 65A–65D, each reservoir containing a different color toner.

As described above, developer roller 22, which is mounted within housing 60, is preferably composed of any suitable electrically conducting material and has a surface composed of a soft polyurethane material, preferably made more electrically conductive by the inclusion of conducting additives. In a preferred embodiment of the invention roller 22 has a small diameter, desirably less than 4 cm and preferably approximately 30 millimeters. Preferably, developer roller 22 includes a metal core, having a diameter of approximately 26 millimeters, coated with a 1.95 millimeter layer of polyurethane having a Shore A hardness of 20. The polyurethane layer is preferably coated with a 4–5 micrometer layer of a conductive lacquer which also extends along the sides of roller 22 so as to be electrically connected to the metal core. The conductive lacquer preferably includes three parts H322 (Lord Corporation, U.S.A.) and 1 part ethyl acetate, however, other conductive lacquers may be suitable. The conductive layer is preferably coated with an additional layer of polyurethane, preferably having a Shore A hardness of 20–25 and a resistivity on the order of $1 \cdot 10^8$ Ω·cm.

The surface of roller 22 protrudes somewhat from the opening of housing 60 such that, when assembly 23 is installed in the imaging apparatus, surface 21 of roller 22 is in contact with photoconductive surface 16 of drum 10. When the apparatus is activated, roller 22 is electrically charged, preferably to a negative voltage of 300–600 volts, for example −400 volts, and is rotated in the direction indicated by arrow 13. A layer of highly concentrated liquid toner is deposited on surface 21 of roller 22, as described below, and thus, roller 22 functions as a developer roller with regard to latent images formed on photoconductive surface 16 of drum 10, as described above with reference to FIG. 1.

In a preferred embodiment of the invention, the pressurized toner received via inlet 62 is deposited on developer roller 22 by a depositing electrode 70 which forms one wall of inlet chamber 63. The opposite wall 72 of inlet chamber 63 is preferably formed of an insulating material, for example a plastic insulator, and is juxtaposed with surface 21 by a distance of approximately 0.5 millimeters. Electrode 70, which is preferably charged to a negative voltage of 900–2000 volts, for example −1400 volts, is preferably situated juxtaposed with a portion of developer roller 22, preferably at a distance of approximately 400 micrometers therefrom. The large difference in voltage between electrode 70 and developer roller 22 causes toner particles to adhere to developer roller 22, while the generally neutral carrier liquid is generally not affected by the voltage difference. The deposited liquid toner is carried by surface 21 of roller 22 in the direction indicated by arrow 13. The layer of liquid toner deposited on surface 21 is preferably at a concentration of 15–17 percent as described below.

In addition to developer roller 22 and electrode 70, assembly 23 includes a squeegee roller 66 and a cleaning roller 74 which are mounted within housing 60 in contact with the surface of developer roller 22. Rollers 66 and 74 are composed of any suitable electrically conducting material, preferably metal, having a smooth surface. The diameters of squeegee roller 66 and cleaning roller 74 are preferably significantly smaller than that of developer roller 22. Thus, if the diameter of roller 22 is approximately 3 centimeters, the diameters of rollers 66 and 74 are preferably approximately 10 millimeters.

When the imaging apparatus is operated, rollers 66 and 74 are electrically charged and are caused to rotate in a sense opposite that of roller 22, as indicated by arrows 67 and 73, while being urged against the resilient surface of roller 22. In a preferred embodiment of the invention, squeegee roller 66 is charged to a negative voltage of 400–800 volts, preferably approximately −600 volts, and cleaning roller 74 is preferably charged to a negative voltage of 0–200 volts.

Squeegee roller 66 is preferably urged against roller 22, at a pressure of approximately 100 grams per centimeter of length, by means of a leaf spring 68, preferably extending along substantially the entire length of the squeegee roller and having a, preferably teflon, tip which engages the surface of roller 66. The tip is preferably formed with grooves in the direction of motion of the surface of roller 66 which prevent accumulation of toner between roller 66 and spring 68 by allowing draining of the toner therefrom.

Alternatively as shown in FIG. 4, the leaf spring includes a wire, preferably of a low friction material such as teflon, wrapped around the leaf as around a core to form a flat coil with an axis along the length of the squeegee roller. The wires are spaced in the winding direction so that they contact the squeegee roller only along discrete portions or points along its length so that the above described draining of toner may occur. Preferably, the spring is formed with spaced winding grooves to position the wire and stabilize its position.

Squeegee roller 66 is operative to squeegee excess carrier liquid from surface 21 of developer roller 22, thereby to further increase the concentration of solids on surface 21. Because of the squeegee action at the region of contact between resilient surface 21 and the surface of squeegee roller 66, a large proportion of the carrier liquid contained within the toner concentrate is squeezed out of the layer, leaving a layer having a solids concentration of 20 percent or more as described below. The excess carrier liquid, which may include a certain amount of toner particles, drains towards toner outlet 64.

Preferably, the ends of squeegee roller 66 and roller 22 are formed with matching chamfered ends to reduce the effects of end overflow. Such chamfered rollers are described more fully in a PCT application titled "Squeegee roller for Imaging Systems" which corresponds to Israel application 111441, filed Oct. 28, 1994. This PCT application, which is incorporated herein by reference, is filed on the same day as the present application.

Cleaning roller 74, by virtue of the relatively low voltage to which it is charged, is operative to remove residual toner from surface 21 of developer roller 22. The toner collected by roller 74 is then preferably scraped off roller 74 by a, preferably resilient, cleaning blade 76 which is urged against the surface of roller 74. The scraped toner is preferably absorbed by a sponge roller 78, which is urged against roller 74 so as to be slightly deformed thereby, preferably by approximately 1.5 millimeters radially. Sponge roller 78 rotates in the same sense as that of roller 74, such that the surfaces of rollers 74 and 78 move in opposite directions at their region of contact. Sponge roller 78 also absorbs some of the excess liquid toner from the deposition region between electrode 70 and roller 22, mainly including carrier liquid, which is drained along the external surface of insulator wall 72 of chamber 63. Roller 78 preferably has a diameter of approximately 20 millimeters and is preferably formed of open-cell polyurethane surrounding a metal core having a diameter of approximately 8 millimeters.

Finally, some of the toner particles and carrier liquid absorbed in sponge roller 78 is squeezed out of the sponge roller by a relatively rigid squeezer roller 80, which is preferably urged deeply into sponge roller 78, desirably approximately 2 millimeters radially. Squeezer roller 80 is preferably an idler roller which rotates in response to the rotation of sponge roller 78.

In a preferred embodiment of the invention, the layer deposited on surface 21 of roller 22 has a very high solids concentration, preferably greater than about 15 percent and typically between 15 and 17 percent, depending on which color toner is deposited. This concentration is much higher than the initial concentration of solids supplied to inlet 62 from reservoir 65, which concentration is generally lower than 8 percent solids and typically between 1.8 and 2 percent solids. Squeegeeing of the deposited layer of toner by squeegee roller 65, as described above, further increases the concentration of solids in the toner layer to approximately 20–50 percent solids, depending on the color of the toner. This high concentration has been found to be almost dry to the touch, non-flowing and crumbly in texture. It has also been found that the quality of the developed latent image is enhanced greatly as a result, and no additional drying mechanism is needed when the image is transferred to final substrate 42. Since so much liquid has been removed from the layer, a thickness of 2–8 micrometers on surface 21 of roller 22 is sufficient.

As roller 22 continues to rotate and interfaces the latent-image-bearing surface of drum 10, portions of the layer of the dry to the touch liquid toner concentrate are selectively transferred to surface 16 of drum 10, thereby developing the latent image as explained above.

After portions of the layer of toner concentrate have been transferred to surface 16 of drum 10 to develop the latent image, the remaining portions of the toner layer on roller 22 continue to rotate on surface 21 until they reach the region of contact with cleaning roller 74. As described above, the relative electrical potentials on roller 22 and roller 74, cause the remaining portions of the toner layer to be transferred to roller 74. Resilient blade 76, which is preferably anchored to housing 60, scrapes off the remaining portions of the toner layer from the surface of roller 74, as described above.

Although a variety of toners are suitable for the present invention, the following toner materials and toner production methods are preferred:

COMPOUNDING

Black, Yellow and Magenta Toners:

10,500 g. of Nucrel 925 resin and 10,500 g. of Isopar-L are charged in a Ross Double Planetary Mixer LDM, 10 gallons. Mixing starts at a speed control setting of 2 and the oil temperature in the heating unit is set to 300° F. After 1 hour of mixing, 9,000 g. of Isopar-L, preheated to 120° C., are added. The speed control setting is raised to 5 for an additional hour. Then the heating unit is turned off and the system gradually cools, for approximately 4 hours, until the temperature of the mixture drops below 45° C., while mixing is maintained at a speed control setting of 5.

Cyan Toner:

7,500 g. of Bynel 2002 resin and 7,500 g. of Isopar-L are charged in a Ross Double Planetary Mixer LDM, 10 gallons. Mixing starts at a speed control setting of 2 and the oil temperature in the heating unit is set to 300° F. After 1 hour of mixing, 15,000 g. of Isopar-L, preheated to 120° C., are added. The speed control setting is raised to 5 for an additional hour. Then the heating unit is turned off and the system gradually cools, for approximately 4 hours, until the temperature of the mixture drops below 45° C., while mixing is maintained at a speed control setting of 5.

GRINDING

Black Toner:

The following materials are mixed in a 30S Union Process attritor, equipped with 3/16" carbon steel balls, at a low speed setting of 2:

17,828.6 g. of the compounding material described above;

1,560.0 g. of Mogul-L (carbon black by Cabot);

156.0 g. of BT583D (blue pigment by Cookson);

117.0 g. of Aluminum Stearate (by Riedl de Haen); and 32,611.4 g. of Isopar-L (by Exxon).

Grinding of the mixture starts at a speed control setting of 6, for approximately 2 hours, until the mixture reaches a temperature of approximately 58–60° C. The attritor is then cooled to a temperature of approximately 42±2° C., while the same grinding speed is maintained. The grinding is stopped after a total grinding period of 22 hours.

Yellow Toner:

The following materials are mixed in a 15S Union Process attritor, equipped with 3/16" carbon steel balls, at a low speed setting of 2:

7,200.0 g. of the compounding material described above;

480.0 g. of Sicofast Yellow D1355DD (by BASF);

67.5 g. of Aluminum Stearate (by Riedl de Haen); and 12,252.0 g. of Isopar-L (by Exxon).

Grinding of the mixture starts at a speed control setting of 5.5, for approximately 2 hours, until the mixture reaches a temperature of approximately 55° C. The attritor is then cooled to a temperature of approximately 34±2° C., while the same grinding speed is maintained. The grinding is stopped after a total grinding period of 22 hours.

Magenta Toner:

The following materials are mixed in a 1S Union Process attritor, equipped with 3/16" carbon steel balls, at a low speed setting of 2:

669.3 g. of the compounding material described above;

14.86 g. of R6300 (pigment by Mobay);

29.64 g. RV6803 (pigment by Mobay);

6.3 g. of Aluminum Stearate (by Riedl de Haen); and 1,250.0 g. of Isopar-L (by Exxon).

The mixture is ground for approximately 20 hours at a temperature of approximately 40±3° C.

Cyan Toner:

The following materials are mixed in a 30S Union Process attritor, equipped with 3/16" carbon steel balls, at a low speed setting of 2:

10,440 g. of the compounding material described above;

390 g. of BT583D pigment (by Cookson);

6 g. of Sicofast Yellow D1355DD (by BASF);

45 g. of Aluminum Stearate (by Riedl de Haen); and 9,125 g. of Isopar-L (by Exxon).

Grinding of the mixture starts at a speed control setting of 6, for approximately 1.5 hours, until the mixture reaches and does not exceed a temperature of approximately 55° C. The attritor is then cooled to a temperature of approximately 34±4° C., while the same grinding speed is maintained. The grinding is stopped after a total grinding period of 24 hours.

MAGNETIC TREATMENT

Black, Yellow, Magenta and Cyan Toners:

The ground toner is taken out of the attritor and placed in an adequate container, where it is diluted to a concentration of approximately 5% solids. Two strong magnets, preferably approximately 12,000 Gauss each, are associated with the bottom of the container The diluted toner is then mixed at approximately 150 RPM for approximately 2 hours.

CONCENTRATION

Black, Yellow, Magenta and Cyan Toners:

The magnetically treated toner is placed in a vacuum nutcha, such as a Buchner Funnel, having a polypropylene cloth support, and is concentrated using a vacuum pump. The toner concentration exceeds 22% solids after approximately 4 hours of pumping.

CHARGING

Black, Yellow, Magenta and Cyan Toners:

The concentrated toner is placed in a planetary mixer. A predetermined amount of charge director is added, preferably approximately 9 milligrams charge director per gram of toner solids. The toner concentration is adjusted, using Isopar-L, to approximately 20% solids. The toner is then pumped into 380 gram containers using a gear pump system. A variety of charge directors known in the art are operative in this embodiment of the invention. A preferred charge director for the present invention, preferably utilizing lecithin, BBP and ICIG3300B, is described in U.S. patent application 07/915,291, now U.S. Pat. No. 5,346,796 and in P.C.T. Publication W.O. 94/02887.

To obtain a concentration of generally less than 8 percent solids, and preferably 1.8–2, as required by the preferred imaging apparatus described above, each toner concentrate is diluted by a predetermined amount of carrier liquid. The toner is generally diluted with Isopar-L type carrier liquid but may additionally include 1–2 percent of Marcol-82. In some embodiments of the invention, the carrier liquid may be at least partially replaced by a grease or petroleum which has a high viscosity and is thixotropic, thereby reducing leaks.

Figure 5:
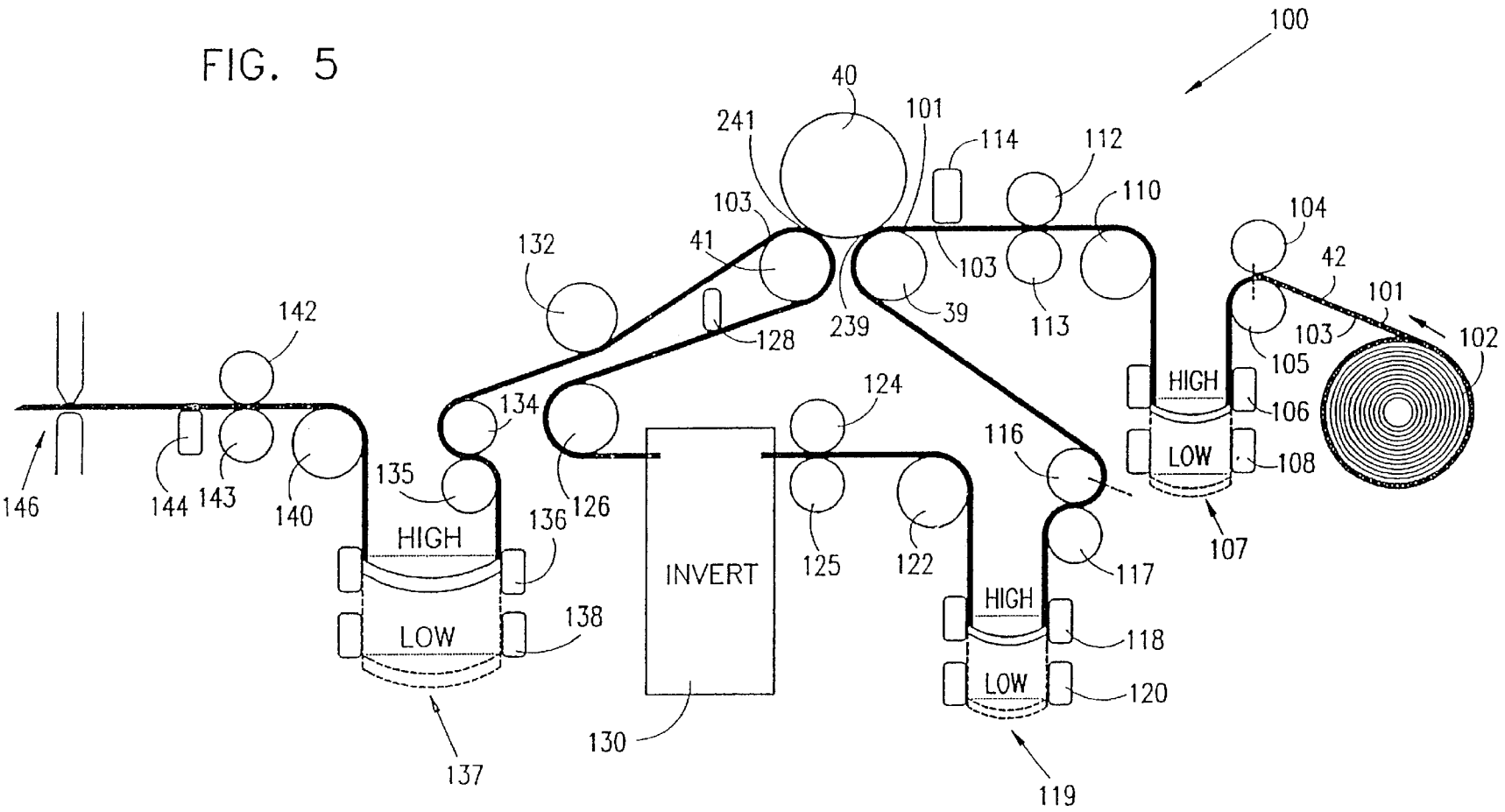
FIG. 5 is a detailed schematic illustration of a web-feeder system constructed and operative in accordance with a preferred embodiment of the present invention.
Figure 6:
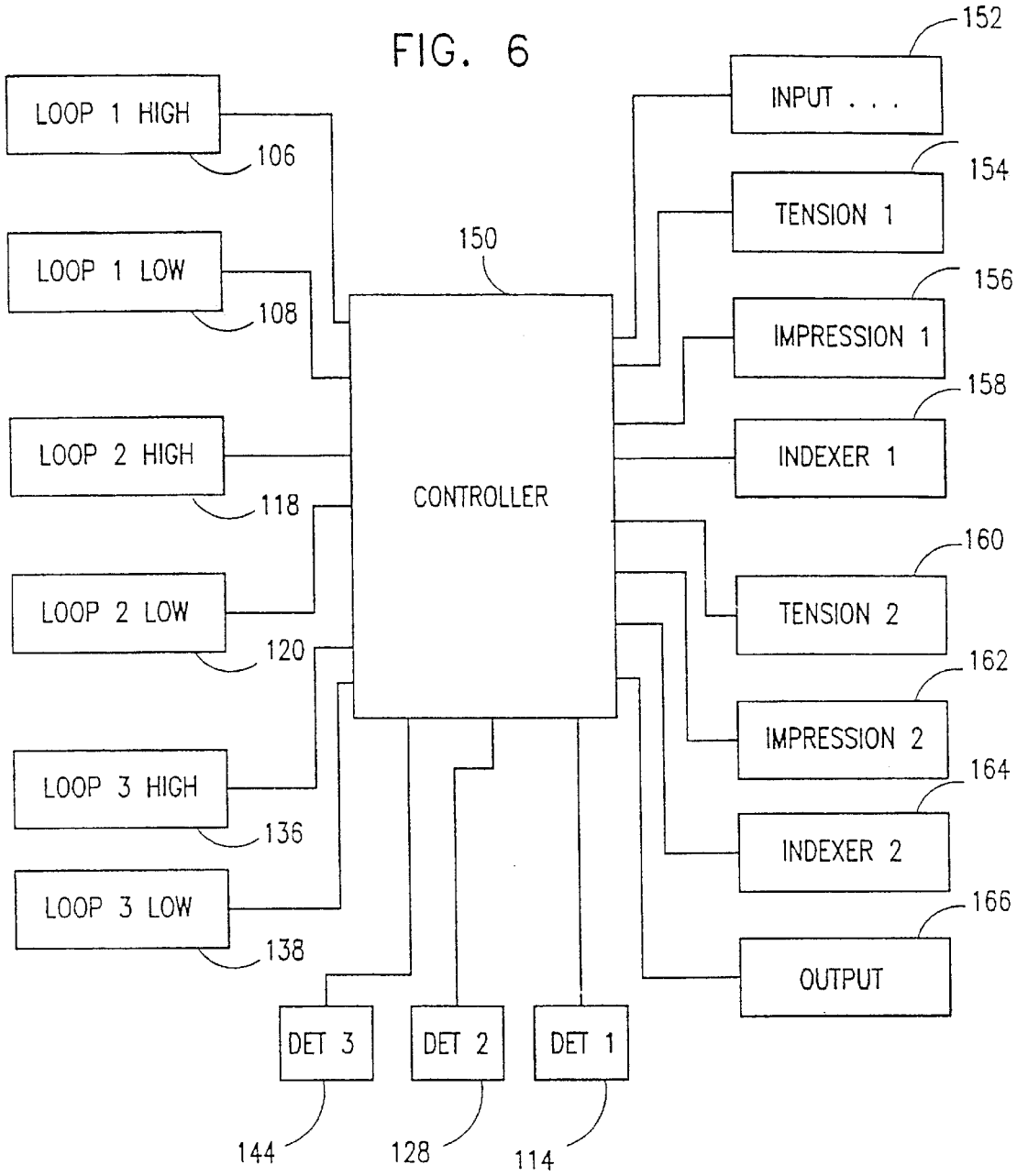
FIG. 6 is a schematic, block diagram, illustration of circuitry for controlling the operation of the system of FIG. 2.
Figure 8:
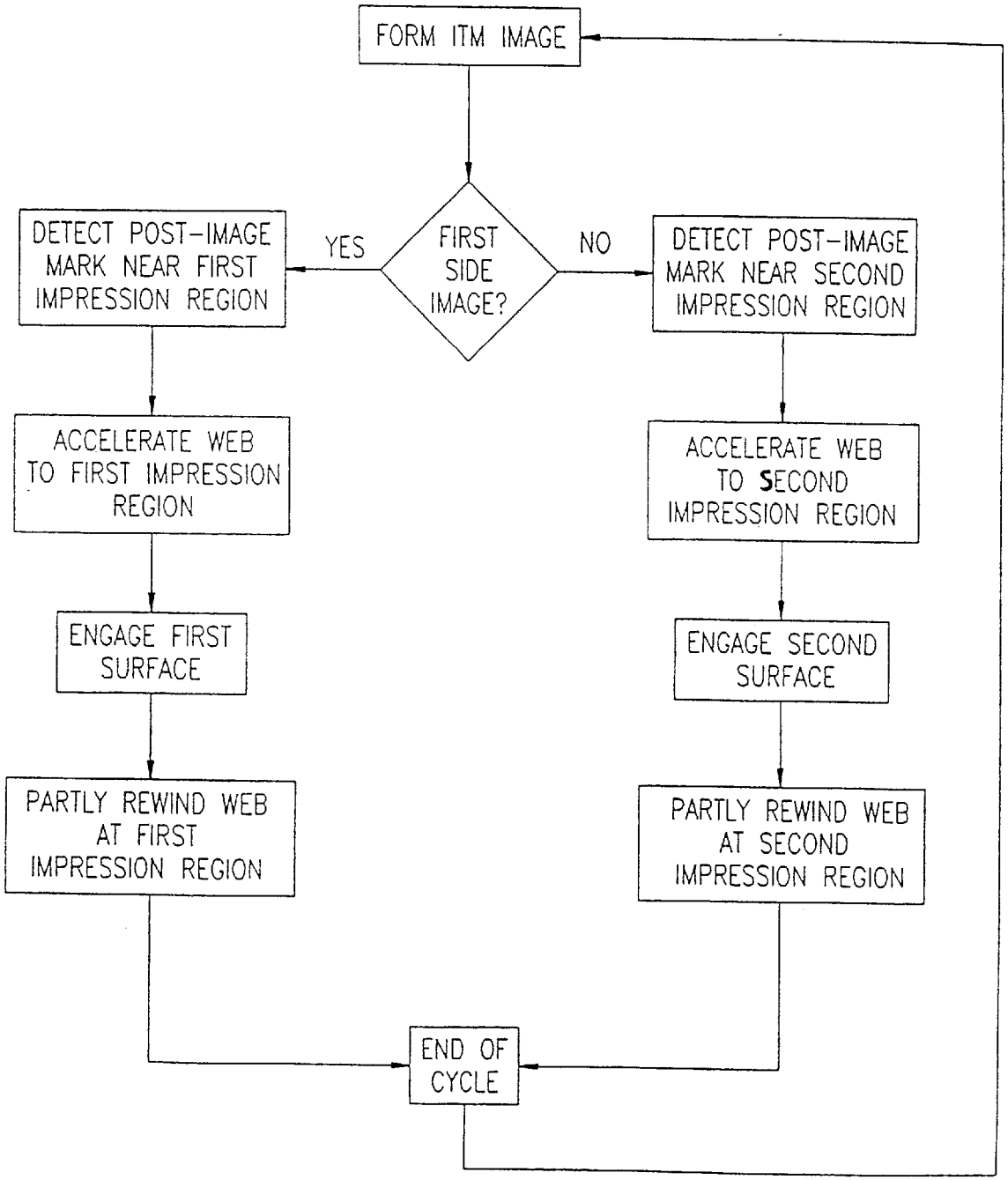
FIG. 8 is a schematic flow-chart showing a preferred sequence of operation of the web-feeder system of FIG. 5.

Reference is now made to FIG. 5, which schematically illustrates a preferred embodiment of web-feeder system 100, and to FIG. 6 which schematically illustrates, in block diagram form, a preferred circuit for controlling the operation of web-feeder system 100. Reference is also made to the flow-chart of FIG. 8 which schematically illustrates a preferred sequence of operation of web-feeder system 100. As described above, with reference to FIG. 1, web-feeder system 100 includes first and second impression rollers 39 and 41 which are alternatively applied to support final substrate 42 against the surface of ITM 40 at regions 239 and 241, respectively.

According to the present invention, as described in detail below, a first surface 101 of substrate 42 engages ITM 40 when roller 39 is urged against the ITM, and a second, opposite surface 103 of substrate 42 engages ITM 40 when roller 41 is urged against the ITM. This arrangement enables imaging on both surfaces 101 and 103 of substrate 42 using a single imaging apparatus, wherein ITM 40 engages surfaces 101 and 103 in accordance with a predetermined imaging sequence, as described below. Rollers 39 and 41 are driven by impression motors 156 and 162, the operation of which is controlled by a controller 150.

Substrate 42, which may be formed of paper or any other suitable material, is preferably a continuous web supplied from a web-dispenser roll 102, through a substrate input arrangement which preferably includes input roller 104 and 105. Input rollers 104 and 105 are preferably driven by an input motor 152, the operation of which is controlled by controller 150 as described below. It should be appreciated that first surface 101, as defined above, is the top surface of continuous substrate 42 when the substrate is between rollers 104 and 105.

The dispensed continuous web 42 is guided to a first free-loop arrangement 107, having maximum height detectors 106 and minimum height detectors 108 associated with controller 150. Detectors 106 are activated when the loop of substrate 42, dispensed into arrangement 107, is above a predetermined maximum height, while detectors 108 are activated when the loop of substrate 42 in arrangement 107 is below a predetermined minimum height. When detectors 106 are activated, controller 150 activates motor 152 so as to dispense more of web 42 from dispenser 102 into loop arrangement 107, thereby to lower the loop in arrangement 107. When detectors 108 are activated, controller 150 deactivates motor 152 so as to stop dispenser 102 from dispensing web 42 into loop arrangement 107, thereby to raise the loop in arrangement 107. In this manner, the length of substrate 42 in loop arrangement 107 is maintained within a predetermined length range which allows sufficient timing flexibility during imaging.

Continuous web 42 is pulled out of free loop arrangement 107, via a support roller 110, by a collection arrangement which preferably includes tension rollers 112 and 113. Rollers 112 and 113 are preferably driven by a tension motor 154 which is controlled by controller 150. Motor 154 is preferably a torque motor operative for maintaining a substantially constant tension in web substrate 42, downstream of rollers 112 and 113, during operation of the web-feeder system.

Downstream of tension rollers 112 and 113, web 42 passes a first detector 114 which is operative for detecting image synchronization marks which are imprinted between images, as described below. Downstream of detector 114, web 42 is supported by impression roller 39 which is driven by an impression motor 156 which, in turn, is activated by controller 150 according to the predetermined imaging sequence. In accordance with a preferred embodiment, impression roller 39 is urged towards impression region 239 of ITM 40 only when first surface 101 of web 42 is to be imaged according to the imaging sequence. In a preferred embodiment, each period of engagement between surface 101 with ITM 40, i.e. each first surface imaging cycle, is initiated by a First Image Trigger signal from controller 150.

According to a preferred embodiment of the invention, before each first surface imaging cycle, web 42 is accelerated by motor 156 and by an indexing motor 158 which is described below, until the velocity of surface 101 is comparable with the surface velocity of ITM 40. This allows position controlled, slip-free, engagement between surface 110 and ITM 40 during imaging on the-first surface. Further, in a preferred embodiment, a preselected post-image mark is imprinted on surface 101 immediately following each image printed thereon. This mark is detectable by first detector 114 and by second and third detectors, 128 and 144, as described in detail below.

In a preferred embodiment, web 42 is partially rewound, preferably by reverse operation of motors 154, 156 and 158, after each first surface imaging cycle. This provides a length of web as necessary for subsequent reacceleration of web 42 for the next first surface imaging cycle. Correct positioning of a given first surface image is enabled by detection of the post-image mark of the preceding first surface image. To prevent false detection of the post-image marks, detector 114 is preferably operative only within preset detection time windows, during which time controller 150 queries for a detection signal. The time gaps between consecutive detection time windows are preferably set in accordance with the page layout of the respective first surface images.

In a preferred embodiment of the invention, the first surface images are reproduced with a minimal spacing, preferably not more than a few millimeters, whereby the post-image marks are imprinted within the boundaries of the spacings. To account for varying page layouts, the images on ITM roller 40 are preferably bottom-justified, such that a substantially constant spacing is maintained between images. It should be appreciated, however, that in an alternative embodiment of the invention pre-image marks may be used rather than post-image marks and, in such an embodiment, the images on the surface of ITM 40 are preferably top-justified.

Web 42, bearing images on first surface 101 thereof, then passes through indexing rollers 116 and 117 which are, preferably, driven by first indexing motor 158. Indexing motor 158 communicates with controller 150 and is operative, together with motor 156, to advance web 42 in accordance with the first surface imaging cycles, i.e. for a specified length of web 42 after each First Image Trigger signal generated by controller 150. The velocity and relative position of web 42 during each first surface imaging cycle are preferably monitored by controller 150 through an encoder which is preferably associated with rollers 116 and 117.

Downstream of indexing rollers 116 and 117, continuous web 42 is guided into a second free-loop arrangement 119, having maximum height detectors 118 and minimum height detectors 120 associated with controller 150. Detectors 118 are activated when the loop of substrate 42 dispensed into arrangement 119 is above a predetermined maximum height, while detectors 120 are activated when the loop of substrate 42 in arrangement 119 is below a predetermined minimum height. When detectors 120 are activated, controller 150 activates a second tension motor 160 which drives second tension rollers 124 and 125, downstream of loop arrangement 119, to collect web 42 from loop arrangement 119 thereby to raise the loop in arrangement 119. When detectors 118 are activated, controller 150 deactivates motor 160 so as to stop tension rollers 124 and 125 from collecting web 42 from loop arrangement 119, thereby to lower the loop in arrangement 119. In this manner, the length of substrate 42 in loop arrangement 119 is maintained within a predetermined length range which allows sufficient imaging timing flexibility.

Motor 160 is preferably a torque motor which maintains a substantially constant tension in web substrate 42, downstream of rollers 124 and 125, during operation of the web-feeder system. Web 42 is preferably collected from second loop arrangement 119 via a support roller 122 similar to support roller 110.

Figure 7A:
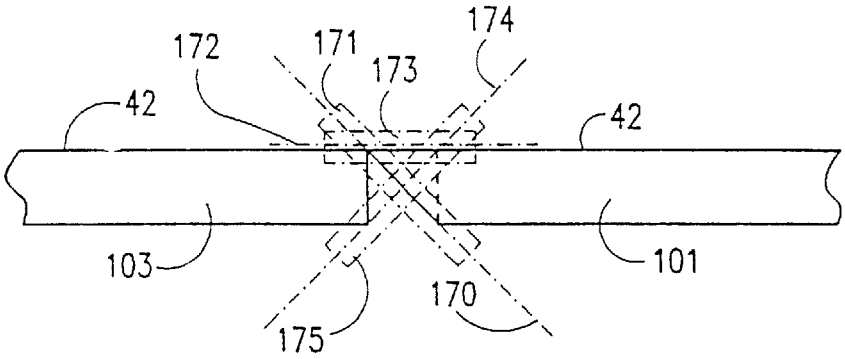
FIGS. 7A and 7B are, respectively, top and perspective, schematic, illustrations depicting a method of inverting a continuous substrate in accordance with a preferred embodiment of the present invention.
Figure 7B:
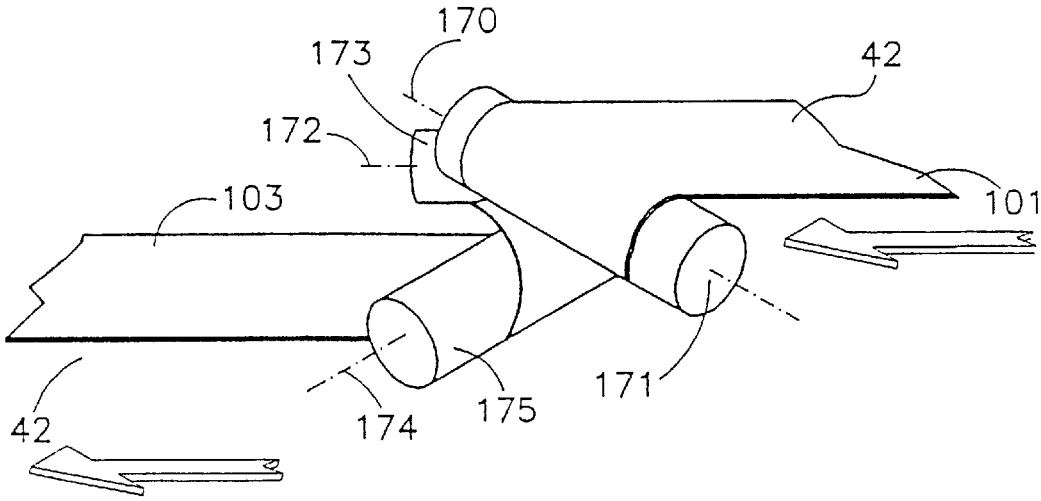

Downstream of roller 122, web 42 enters an inverter mechanism 130 which inverts substrate 42 such that, at the exit of inverter 130, first surface 101 becomes the bottom surface of substrate 42 and surface 103 becomes the top surface thereof. Reference is now made also to FIGS. 7A and 7B which schematically illustrates inversion of continuous substrate 42 in accordance with a preferred embodiment of the present invention.

According to the preferred embodiment of FIGS. 7A and 7B, substrate 42 is "folded" three times, about three respective axes. For example, substrate 42 may be folded, first, about a 45 degree axis 170, then, about an axis 172 parallel to the advance of substrate 42 and, finally, about another 45 degree axis 174. It should be appreciated that such triple "folding" of substrate 42 by inverter 130 results in an inverted substrate 42 whose direction of motion is generally parallel to the original direction but has second surface 103 as its top surface. Folding at the above specified axes is preferably performed by providing elongated rollers 171, 173 and 175, having preselected diameters, along axes 170, 172 and 174, respectively. To prevent damage to substrate 42, rollers 171, 173 and 175 are preferably appropriately separated, as shown schematically in FIG. 7B, such that substrate 42 is folded by less then 180 degrees at each axis.

It should be appreciated that other configurations of inverter 130 may be equally suitable for inverting the surfaces of substrate 42 as described above, for example a Mobius belt arrangement wherein the substrate is inverted by being gradually rotated about its longitudinal axis while being advanced. However, the arrangement of FIGS. 7A and 7B has been found to be effective in operation and economic in space.

Downstream of inverter mechanism 130, web 42 is directed around a support roller 126 towards impression roller 41, passing a second detector 128 which is operative for detecting the post-image synchronization marks imprinted between the images on surface 101. Impression roller 41 is driven by a second impression motor 162, which is activated by controller 150 in accordance with the predetermined imaging sequence. In accordance with a preferred embodiment, impression roller 41 is urged against the surface of ITM 40 only when second surface 103 of web 42 is to be imaged according to the imaging sequence. In a preferred embodiment, each period of engagement between surface 103 with ITM 40, i.e. each second surface imaging cycle, is initiated by a Second Image Trigger signal from controller 150.

According to a preferred embodiment of the invention, before each second surface imaging cycle, web 42 is accelerated by motor 162 and by a second indexing motor 164 which is described below, until the velocity of surface 103 is comparable with the surface velocity of ITM 40. This allows position controlled, slip-free, engagement between surface 103 and ITM 40 during imaging on the second surface.

In a preferred embodiment, web 42 is rewound, preferably by reverse operation of motors 160, 162 and 164, after each second surface imaging cycle. This provides the length of web necessary for subsequent reacceleration of web 42 for the next second surface imaging cycle. Correct positioning of a given second surface image is enabled by detection of the post-image mark of the preceding first surface image, so as to accurately position the given second surface image opposite its corresponding image on surface 101.

To prevent false detection of the post-image marks, detector 128 is preferably operative only within preset detection time windows, during which time controller 150 queries for a detection signal therefrom. The time gaps between consecutive detection time windows are preferably the same as those of the respective first surface images. These time gaps are preferably calculated by controller 150 based on the substrate length of the corresponding images, as measured by the encoders associated with indexer rollers 116 and 117.

It is appreciated that in order to maintain the minimal spacing between images, as described above, the page layout of each image on surface 103 is preferably the same as that of the corresponding image on surface 101. The second surface images are preferably bottom-justified on ITM 40, as described above regarding the first surface images.

Web 42, which now bears a series of images on first surface 101 and a corresponding series of images on opposite surface 103, is guided by a roller 132 and then passes through a second indexing rollers 134 and 135 which are preferably driven by second indexing motor 164. Indexing motor 164 communicates with controller 150 and is operative together with motor 160, to advance web 42 in accordance with the second surface imaging cycles, i.e. for a specified length of web 42 after each Second Image Trigger signal generated by controller 150. The velocity and relative position of web 42 during each second surface imaging cycle are preferably monitored by controller 150 through an encoder which is preferably associated with rollers 134 and 135.

Downstream of indexing rollers 134 and 135, continuous web 42 is guided into a third free-loop arrangement 137, having maximum height detectors 136 and minimum height detectors 138 associated with controller 150. Detectors 136 are activated when the loop of substrate 42 dispensed into arrangement 137 is above a predetermined maximum height, while detectors 138 are activated when the loop of substrate 42 in arrangement 137 is below a predetermined minimum height. When detectors 138 are activated, controller 150 activates an output motor 166 which drives output rollers 142 and 143, downstream of a support roller 140, to collect web 42 from loop arrangement 137 thereby to raise the loop in arrangement 137. When detectors 136 are activated, controller 150 deactivates motor 166 so as to stop output rollers 142 and 143 from collecting web 42 from loop arrangement 137, thereby to deepen the loop in arrangement 137. In this manner, the length of substrate 42 in loop arrangement 137 is maintained within a predetermined length range which allows sufficient imaging timing flexibility.

The double-sided image bearing substrate 42 exiting output rollers 142 and 143 is then cut between images by a cutter 146, as known in the art. To enable cutting of substrate 42 precisely at the spaces between consecutive double-sided images, a third detector 144 is provided between rollers 142 and 143 and cutter 146 for detecting the post-image marks imprinted between the images on surface 101. The position of substrate 42 relative to cutter 146 is adjusted by controlled operation of output motor 146 based on the detection signals from third detector 144 to controller 150.

To prevent false detection of the post-image marks, detector 144 is preferably operative only within preset detection time windows, during which time controller 150 queries for a detection signal therefrom. The time gaps between consecutive detection time windows are preferably the same as those of the respective first and second surface images. These time gaps are preferably calculated by controller 150 based on the substrate length of the corresponding images, as measured by the encoders associated with indexer rollers 134 and 135.

In the preferred embodiment described above, eight motors are involved in the operation of the web-feeder system, namely, motors 152, 154, 156, 158, 160, 162, 164 and 166. According to a preferred embodiment of the invention, motors 152-164 are brushless servo-motors driven by a plurality of corresponding digital servo-drivers (not shown), as known in the art.

The predetermined imaging sequence, according to which controller 150 controls the operation of web-feeder system 100, may be as follows. First, a predetermined number of images are reproduced on first surface 101 to account for the length of continuous substrate 42 separating between first impression roller 39 and second impression roller 41. Then, ITM 40 is alternatingly engaged by surfaces 101 and 103 such that each first surface imaging cycle is followed by a second surface imaging cycle.

It should be noted that, inherently, there is a considerable time gap between imaging of a given image on surface 101 and imaging of the corresponding image on surface 103, due to the length of continuous substrate 42 between region 239 and region 241. Similarly, there is an inherent time gap between imaging of the second surface images and cutting of substrate 42 by cutter 146, due to the length of continuous substrate 42 between region 241 and cutter 146. It should be further noted that the length of substrate 42 between impression region 239 and impression region 241 varies in accordance with the length of substrate 42 reserved in loop arrangement 119. Similarly, the length of substrate 42 between impression region 241 and cutter 146 varies in accordance with the length of substrate 42 reserved in loop arrangement 137. Therefore, the present invention provides an initiation procedure for synchronizing between the first surface imaging cycles, the second surface imaging cycles and the cutting of substrate 42.

According to the initiation procedure of the present invention, imaging begins with substrate 42 being at a "stretched-out" configuration, wherein substrate 42 is stretched across loop arrangements 119 and 137, i.e. extends directly from indexers 116 and 117 to roller 122 and from indexers 134 and 135 to roller 140. It should be appreciated that in this configuration, the length of substrate 42 between impression regions 239 and 241 and the length of substrate 42 between region 241 and cutter 146 are both well defined.

A plurality of first surface images are then produced on surface 101, as described above, and controller 150 keeps track of the length of substrate 42 passing through impression region 239, for example by measuring the length of substrate passing through indexer rollers 116 and 117. This length may be added to the known length of the stretched substrate between regions 239 and 241. The advance of substrate 42 through region 239 results in deepening of the loop of substrate in loop arrangement 119, until minimum height detectors 120 are activated as described above. At this stage, substrate 42 starts to advance also through impression region 241, and the length of this advance is monitored by controller 150 using indexer rollers 134 and 135. The length of substrate 42 between regions 239 and 241 is monitored by controller 150 by subtracting the length measured at indexers 134 and 135 from the length measured at indexer 116 and 117. Based on this information, controller 150 synchronizes between the detection time windows of the first surface imaging cycles and the corresponding detection windows of the second surface imaging cycles.

The advance of substrate 42 through region 241 results in deepening of the loop of substrate in loop arrangement 137, until minimum height detectors 138 are activated as described above. At this stage, substrate 42 starts to advance also through cutter 146. The length of substrate 42 between region 241 and cutter 146 is readily monitored by controller 150 by adding the length measured at indexers 134 and 135 to the initial length of substrate stretched between region 241 and cutter 146. Based on this information, controller 150 synchronizes between the detection time windows of the imaging cycles and the corresponding detection windows which are used for timing the cutting at cutter 146.

It will be appreciated by persons skilled in the art that the present invention is not limited to what has been particularly shown and described hereinabove. Rather, the scope of the present invention is defined only by the claims that follow:

What is claimed is:

1. Image forming apparatus for double-sided imaging on a continuous-web substrate, having first and second surfaces on opposite sides of the substrate, comprising:

an imaging device comprising an image bearing surface moving in a given direction and having selectively formed thereon first and second images; and a web-feeder system which selectively brings said first and second substrate surfaces into operative engagement with said image bearing surface, to transfer thereto said first and second images, respectively, in accordance with a preselected imaging sequence, wherein the first substrate surface engages the image bearing surface at a first transfer region and the second substrate surface engages the image bearing surface at a second transfer region, the second transfer region being displaced from the first transfer region in the given direction.

2. Apparatus according to claim 1 wherein the predetermined imaging sequence comprises first surface imaging cycles, during which cycles the first images are transferred to the first substrate surface, and second surface imaging cycles, during which cycles the second images are transferred to the second substrate surface.

3. Apparatus according to claim 2 wherein the predetermined imaging sequence comprises a plurality of consecutive first surface imaging cycles followed by alternating, first surface and second surface, imaging cycles.

4. Apparatus according to claim 3 wherein the web-feeder system comprises a first impression member which urges the continuous substrate against the image bearing surface during each first surface imaging cycle, and a second impression member which urges the continuous substrate against the image bearing surface during each second surface imaging cycle.

5. Apparatus according to claim 4 wherein the web-feeder system further comprises a substrate inverter, operating on the continuous substrate between said first and second impression members, which inverts between the first and second surfaces of the continuous substrate.

6. Apparatus according to claim 4 wherein the web-feeder system comprises a substrate advance mechanism operative for advancing the continuous substrate through said first and second transfer regions.

7. Apparatus according to claim 6 wherein the web-feeder system further comprises a controller which controls the advance of the continuous substrate through the first and second transfer regions, in accordance with the predetermined imaging sequence, by controlling the operation of the substrate advance mechanism.

8. Apparatus according to claim 7 wherein the controller controls the engagement and disengagement of said first and second substrate surfaces with said image bearing surface, in accordance with the predetermined imaging sequence, by controlling the position of the first and second impression members relative to the image bearing surface.

9. Apparatus according to claim 7 wherein the first images are formed on the first substrate surface with a preselected spacing.

10. Apparatus according to claim 9 wherein the imaging device produces a post-image mark on the space following each first image on the first substrate surface.

11. Apparatus according to claim 10 wherein the advancing mechanism rewinds a preselected length of the continuous substrate through the first transfer region following each first surface imaging cycle.

12. Apparatus according to claim 11 wherein the continuous substrate is accelerated to a surface velocity comparable with that of the image bearing surface before each first surface imaging cycle.

13. Apparatus according to claim 11 wherein the web-feeder system further comprises a first mark detector associated with the first substrate surface, ahead of the first transfer region, which detects the post image marks on the first substrate surface and produces first detection signals in response thereto.

14. Apparatus according to claim 13 wherein the controller triggers each first surface imaging cycle in response to the first detection signal of the preceding post-image mark.

15. Apparatus according claim 11 wherein the advance mechanism rewinds a preselected length of the substrate through the second transfer region following each second surface imaging cycle.

16. Apparatus according to claim 15 wherein the continuous substrate is accelerated to a surface velocity comparable with that of the image bearing surface before each second surface imaging cycle.

17. Apparatus according to claim 16 wherein the web-feeder system further comprises a second mark detector associated with the second substrate surface, ahead of the second transfer region, which detects the post image marks on the first substrate surface and produces second detection signals in response thereto.

18. Apparatus according to claim 17 wherein the controller triggers each second surface imaging cycle in response to the second detection signal of the preceding post-image mark.

19. Apparatus according to claim 11 wherein the web-feeder system further comprises a cutter, associated with the continuous substrate downstream of the second transfer region, which cuts the continuous substrate at the spaces between the first images on the first substrate surface.

20. Apparatus according to claim 19 wherein the web-feeder system further comprises a third mark detector associated with the first substrate surface, ahead of the cutter, which detects the post image marks on the first substrate surface and produces third detection signals in response thereto.

21. Apparatus according to claim 20 wherein the controller activates the cutter in response to the third detection signals.

22. Apparatus according to claim 11 wherein the web-feeder system further comprises at least one free-loop arrangement which contains a variable length of the continuous substrate.

23. Apparatus according to claim 22 wherein the at least one free-loop arrangement comprises a first free-loop arrangement ahead of the first transfer region.

24. Apparatus according to claim 23 wherein the at least one free-loop arrangement comprises a second free-loop arrangement between the first transfer region and the second transfer region.

25. Apparatus according to claim 24 wherein the web-feeder system further comprises a third free-loop arrangement, between the second transfer region and the cutter, which contains a variable length of the continuous substrate.

26. Apparatus according to claim 11 wherein the web-feeder system further comprises a first length detector, associated with the continuous substrate between the first and second transfer regions, which produces an electric output responsive to the position of the continuous substrate relative to the first transfer region.

27. Apparatus according to claim 26 wherein the first length detector comprises an encoder.

28. Apparatus according to claim 26 wherein the controller addresses the first mark detector only within preset, first, detection time windows and wherein the time gaps between the first detection windows are set in accordance with the output of the first length detector.

29. Apparatus according to claim 26 wherein the web-feeder system further comprises a second length detector, associated with the continuous substrate downstream of the second transfer region, which produces an electric output responsive to the position of the continuous substrate relative to second transfer region.

30. Apparatus according to claim 29 wherein the second length detector comprises an encoder.

31. Apparatus according to claim 29 wherein the controller addresses the second mark detector only within preset, second, detection time windows and wherein the time gaps between the second detection windows are set in accordance with the outputs of the first and second length detectors.

32. Apparatus according to claim 29 wherein the controller addresses the third mark detector only within preset, third, detection time windows and wherein the time gaps between the third detection windows are set in accordance with the output of the second length detector.

33. Apparatus according to claim 1 wherein the image bearing surface comprises a developed imaging surface.

34. Apparatus according to claim 33 wherein the imaging surface comprises a photoreceptor surface.

35. Apparatus according to claim 1 wherein the imaging device comprises an intermediate transfer member and wherein the image bearing surface comprises a surface of the intermediate transfer member.

36. Apparatus according to claim 1 wherein at least some of the images comprise toner images.

37. A method for double-sided imaging on a continuous-web substrate, having first and second surfaces on opposite sides of the substrate, using an imaging device including an image bearing surface, the method comprising:

providing a series of first images on said image bearing surface;

transferring each image of the series of first images from the image bearing surface to the first substrate surface;

providing a series of second images on said image bearing surface; and transferring each image of the series of second images from the image bearing surface to the second substrate surface, wherein none of the images in the series of first images are transferred simultaneously with any of the images in the series of second images and wherein providing said series of first images and said series of second images comprises first, consecutively forming a plurality of first images and, then, alternatingly forming first and second images.

38. An imaging method according to claim 37 wherein transferring each image of the series of first images comprises transferring the images in the series of first images at a first transfer region and wherein transferring each image of the series of second images comprises transferring the images in the series of second images at a second transfer region.

39. An imaging method according to claim 38 herein the image bearing surface moves in a given direction and wherein the second transfer region is displaced from the first transfer region in the given direction.

40. An imaging method according to claim 38 and further comprising inverting the first and second substrate surfaces of the continuous substrate between the first and second transfer regions.

41. An imaging method according to claim 38, wherein said providing a series of first images, said transferring each image of the series of first images, said providing a series of second images and said transferring each image of the series of second images are performed in accordance with a predetermined image sequence and further comprising advancing the continuous substrate through said first and second transfer regions in accordance with said predetermined imaging sequence.

42. An imaging method according to 38 wherein transferring each images of the series of first images to the first substrate surface comprises transferring the images with a preselected spacing.

43. An imaging method according to claim 42 and further comprising producing a post-image mark on the space following each first image.

44. An imaging method according to claim 43 and further comprising rewinding a preselected length of the continuous substrate through the first transfer region following transferring of each first image.

45. An imaging method according to claim 44 and further comprising accelerating the continuous substrate to a surface velocity comparable with that of the image bearing surface before transferring of each first image.

46. An imaging method according to claim 45 and further comprising detecting the post image marks on the first substrate surface ahead of the first transfer region.

47. An imaging method according to claim 46 and further comprising triggering a transferring of each first image in response to a post-image mark of a preceding first toner image.

48. An imaging method according to claim 44 and further comprising rewinding a preselected length of the continuous substrate through the second transfer region following transferring of each second image.

49. An imaging method according to claim 48 and further comprising accelerating the continuous substrate to a surface velocity comparable with that of the image bearing surface before transferring of each second image.

50. An imaging method according to claim 49 and further comprising detecting the post image marks on the first substrate surface between the first transfer region and the second transfer region.

51. An imaging method according to claim 50 and further comprising triggering the transferring of each second image in response to the post-image mark of the preceding second image.

52. An imaging method according to claim 44 and further comprising cutting the continuous substrate at the spaces between the first images on the first substrate surface.

53. An imaging method according to claim 52 and further comprising detecting the post image marks on the first substrate surface downstream of the second transfer region.

54. An imaging method according to claim 52 and wherein cutting the continuous substrate comprises cutting the continuous substrate in response to detection of the post-image marks.

55. An imaging method according claim 44 and further comprising monitoring the position of the continuous substrate relative to the first transfer region.

56. An imaging method according to claim 55 wherein detecting the post-image marks on the continuous substrate ahead of the first transfer region comprises detecting the post-image marks only within preset, first, detection time windows.

57. An imaging method according to claim 56 and further comprising setting the time gaps between said first detection time windows in accordance with the monitored position of the continuous substrate relative to the first transfer region.

58. An imaging method according to claim 55 and further comprising monitoring the position of the continuous substrate relative to the second transfer region.

59. An imaging method according to claim 58 wherein detecting the post-image marks on the continuous substrate between the first and second transfer regions comprises detecting the post-image marks only within preset, second, detection time windows.

60. An imaging method according to claim 59 and further comprising setting the time gaps between said second detection time windows in accordance with the monitored position of the continuous substrate relative to the second transfer region.

61. An imaging method according to claim 37 wherein the image bearing surface comprises an imaging surface on which a latent image has been developed.

62. An imaging method according to claim 61 herein the imaging surface comprises a photoreceptor surface.

63. An imaging method according to claim 37 wherein the imaging device comprises an intermediate transfer member and wherein the image bearing surface comprises a surface of the intermediate transfer member.

* * * * *